US006679514B2

(12) United States Patent
Luitz et al.

(10) Patent No.: US 6,679,514 B2
(45) Date of Patent: Jan. 20, 2004

(54) BINDING SUPPORT PLATE AND BOARD-TYPE RUNNER FOR SAME

(75) Inventors: Max Luitz, Blaichach-Bihlerforf (DE); Adolf Stonig, Kleinarl (AT)

(73) Assignee: Atomic Austria GmbH, Altenmarkt im Pongau (AT)

( * ) Notice: Subject to any disclaimer, the term of this patent is extended or adjusted under 35 U.S.C. 154(b) by 107 days.

(21) Appl. No.: 09/949,589

(22) Filed: Sep. 10, 2001

(65) Prior Publication Data

US 2002/0047250 A1 Apr. 25, 2002

(30) Foreign Application Priority Data

Sep. 11, 2000 (AT) ..... 1535/00

(51) Int. Cl.[7] ..... A63C 5/00

(52) U.S. Cl. ..... 280/607; 280/611; 280/602; 280/617; 280/618

(58) Field of Search ..... 280/607, 611, 280/601, 602, 616, 617, 618, 633, 634, 636, 14.21

(56) References Cited

U.S. PATENT DOCUMENTS

| | | | | |
|---|---|---|---|---|
| 5,480,175 A | * | 1/1996 | Astier et al. | 280/607 |
| 5,513,872 A | * | 5/1996 | Arduin et al. | 280/602 |
| 5,671,939 A | * | 9/1997 | Pineau | 280/602 |
| 5,671,940 A | | 9/1997 | Abondance | |
| 6,056,310 A | * | 5/2000 | Hangl | 280/607 |
| 6,065,895 A | * | 5/2000 | Lehner et al. | 403/105 |
| 6,217,055 B1 | * | 4/2001 | Silva | 280/607 |
| 6,244,616 B1 | * | 6/2001 | Arduin et al. | 280/602 |
| 6,305,706 B1 | * | 10/2001 | Resch | 280/602 |
| 6,454,291 B1 | * | 9/2002 | Hillairet et al. | 280/623 |
| 6,471,235 B1 | * | 10/2002 | Luitz et al. | 280/618 |
| 6,513,826 B1 | * | 2/2003 | Hangl | 280/602 |
| 2002/0135157 A1 | * | 9/2002 | Kruajitch | 280/607 |

FOREIGN PATENT DOCUMENTS

| | | | | |
|---|---|---|---|---|
| DE | 297 15 468 | | 8/1987 | |
| EP | 1 104 185 | | 3/1983 | |
| EP | 0 908 203 | | 4/1999 | |
| EP | 0 938 917 | | 9/1999 | |
| EP | 1 000 640 | | 5/2000 | |
| EP | 1 000 641 | | 5/2000 | |
| FR | 0403675 | A1 * | 12/1990 | A63C/11/00 |
| FR | 0506064 | A1 * | 9/1992 | A63C/9/00 |
| FR | 2 713 101 | | 11/1993 | |

* cited by examiner

*Primary Examiner*—Brian L. Johnson
*Assistant Examiner*—J. Allen Shriver
(74) *Attorney, Agent, or Firm*—Collard & Roe, P.C.

(57) ABSTRACT

A binding unit support comprises a support body of a length approximately that of the binding unit and having a longitudinal axis, distal end regions of the support body receiving jaw bodies of the binding unit, a bottom face of the support body having at least part regions designed to sit on a top face of a board-type runner, and a middle region of the support body being of a lesser structural stiffness than the end regions. A fixing device mounts the support body on the top face of the board-type runner, the fixing device comprising longitudinally spaced brackets extending transversely over at least one of the end regions across the support body and guiding the support body for freely sliding in the longitudinal direction relative to the top face of the board-type runner.

43 Claims, 7 Drawing Sheets

VI
VI

VIII
VIII

BINDING SUPPORT PLATE AND BOARD-TYPE RUNNER FOR SAME

BACKGROUND OF THE INVENTION

1. Field of the Invention

The invention relates to a binding support plate, in particular an interface system between a binding unit for retaining, releasably if necessary, a boot and a board-type runner, having a single- or multiple-component support body of a length approximately that of a binding unit, the distal end regions of which are provided as a means of receiving jaw bodies or guide tracks for jaw bodies of a binding unit and the bottom face of which is designed, at least in part regions, to sit on the top face of a board-type runner, and a runner, in particular a ski, having several layers between a running surface layer and a top layer forming an integral sandwich unit and the top face of which is designed either to support a binding unit directly or so that a plate-shaped binding support plate can be mounted between the top face of the runner and the bottom face of the binding unit.

2. The Prior Art

Numerous designs of so-called binding support plates or interface systems between a ski and a binding unit are known. One function of these binding support plates is to elevate the standing position of a user relative to a ski, thereby preventing the ski boot from prematurely coming into contact with the piste when the user is in a very inclined position, particularly when turning. In order to ensure that the runner is not rendered too stiff by the binding support plate, a stable binding support plate is either joined to the ski at the centre region only or bent front ends of a plate part are mounted on the top face, one end region being screwed fast to the ski whilst the end region remote therefrom is joined to the ski by means of elongated holes in which screws are inserted, as described in document EP 0 104 185 B1, for example. To ensure that these plates are capable of withstanding the forces acting on them, they have had to be made to a relatively solid design and of a large volume and the relatively high natural stiffness of the binding support plate or the forces centrally transmitted between the ski and the binding support plate have a marked and perceptible effect on the running properties of the ski.

SUMMARY OF THE INVENTION

The objective of the present invention is to propose an interface system between a runner and a binding unit that will have the least possible effect on the elastic deformation properties built into the runner by the manufacturer as well as a runner designed accordingly.

This objective is achieved by the invention by means of a binding support plate, where a middle region of the single-component support body is of a lesser structural stiffness than the two end regions thereof and at least one end region of the support body can be mounted by means of clamp-type fixing means on the top face of a runner so as to slide freely in the binding longitudinal direction. The advantage of this system is that the bending resistance and the structural stiffness of the longitudinal, profiled support body can be designed to be relatively low transversely to its longitudinal direction, so that it has barely any effect on the inherent bending characteristics or elasticity properties of the runner or ski. This advantage is assisted due to the fact that because at least one end region of the support body is mounted in a free-sliding arrangement, the runner is not placed under any strain in the region of the binding mounting but is able to deform, in particular bend, and is so as far as possible decoupled from the support body. These features also largely avoid any compressive or tensile stress in the support body. Another significant advantage is the fact that the support body, which assumes the function of transferring the force, can be made relatively slim and to what might in principle appear to be a relatively unstable design due to the clamp-type fastening means but nevertheless provides a highly stable and break-resistant arrangement on the top face of a runner. Because the fastening clamps at least partially overlap transversely across the support body, fixing regions of a relatively large surface area can be provided on the support body, which are also capable of withstanding a high input of forces. In particular, there is no need to provide orifices for fixing screws in the support body, affording a high resistance to breaking in spite of the relatively small dimensions in cross section. The clamp-type fastening means also avoid causing weakness in the support body in regions where the highest loads or forces act locally. The binding support plate proposed by the invention therefore offers high stability values in spite of a relatively low natural stiffness and gives rise to hardly any or very few repercussions on the deformation properties of the runner.

As a result of another advantageous embodiment, where the clamp-type fixing means extend transversely to the longitudinal axis of the support body and transversely to the binding longitudinal axis, the runner is not rendered significantly stiffer or blocked, even in the region where the fastening clamps are mounted fast with the ski.

The advantage of a binding support plate, where the clamp-type fixing means extend in the manner of a bracket across the support body, is that the support body can be very securely mounted on the top face of the runner even though the walls of the fastening clamps are relatively thin.

The advantage offered by an embodiment, in which the clamp-type fixing means are provided in the form of half-open fixing clamps, orifices or slits being provided in the end regions thereof to receive fixing screws, is that the fastening clamps may also be of a relatively low structural stiffness if the material from which the fastening clamps are made has an adequate tensile or stretching resistance.

A binding support plate, where the shape of the fix clamps is at least partially adapted to the contour of the support body in the respective fixing region, ensures that the support body is guided with as little clearance as possible, with a low surface contact pressure between the matching guide parts.

Optimum bending capacity, i.e. as low a natural stiffness as possible, of the support body can be obtained, when the end regions of the support body provided as a means of supporting the jaw bodies are designed so that they are elevated in the manner of a block above the surrounding part regions, in particular elevated above the middle region or when that the contour of the support body seen in plan view is that of a dog's bone or dumb bell or when the support body has a slim, skeletal-type structure.

A design, where at least a part region of the bottom face of the support body is designed to complement a profiling of the top face of a ski or where the bottom face of the support body can be displaced at least partially in a positive fit in engagement with a surface profiling of a runner, is of particular advantage because, although the support body has a low transverse stability, the support body stays very true to the desired position on the runner, even under high loads. In particular, the support body can be made even slimmer and dimensioned to an even smaller cross section as a result and still reliably withstand the high loads placed on it.

A further embodiment, in which the profiling of the bottom face of the support body, complementing a top face of a runner, forms, in conjunction with the runner profiling, a longitudinal guide device extending in the direction of the binding longitudinal axis, enables the binding support plate to be positioned accurately in the direction running transversely to the binding longitudinal axis. Furthermore, any strain between the support body and the runner is avoided when the runner deforms.

As a result of the embodiment, where a cover element is designed to at least partially cover the bearing frame-type support body, the load-bearing support body, which is visually rather unattractive as a rule, can be effectively covered by simple means which determine the overall appearance of the binding support plate.

A binding support plate, where the cover element is provided as a flexible injection-moulded component made from a plastics material, offers simple ways and means by which a whole range of different designs can be used for the binding support plate.

The overall visual impression of the binding support plate can be modified in terms of stability, dynamics and the intended target group due to advantageous embodiments, in which a width of the cover element remains substantially constant in the longitudinal direction thereof or in which the flexible cover element determines the visual appearance and the external contour of the interface system.

An embodiment, in which pre-defined bores for receiving fixing screws are provided in the region of mounting zones for mounting jaw bodies or guide tracks, offers a seamless and rapid means of fixing binding units.

The advantage of the embodiment, where a penetration depth of the fixing screws for the jaw bodies or for a guide track is shorter than a thickness of the support body in the region of the mounting zones, is that the runner and the support body can still be displaced relative to one another when the runner is flexed, even after mounting the binding unit.

The advantage of a binding support plate, where the fixing clamps are disposed in the immediately adjacent region around or in the mounting zones for the jaw bodies, is that in spite of the fact that the support body has a low natural stability, it provides a very secure mounting for the binding unit on the runner. In particular, support body parts made from plastics or similar can be used, which can be produced easily and on a rational scale.

The clamp-type fastening means, which are of a hat-shaped design with a slit in the receiving region for the fixing screws transversely to the longitudinal axis of the support body, are relatively simple to produce. Under certain circumstances, fastening means of this type can be cut to the right length from an appropriate profiled section.

Also of advantage is an embodiment, where a clearance width between guide arms of the fixing clamps aligned approximately perpendicular to the plane of the mounting zones is smaller than a width of the mounting zones running transversely to a longitudinal median axis of the support body, because it enables the fixing screws to be screwed into the top face of the runner, which means that there are barely any restrictions to the type of runner with which it may be used.

Of particular advantage is another embodiment, in which at least one fixing clamp has at least one retaining extension which overlaps a peripheral region of the mounting block with the mounting zones, or in which a width of the retaining extension measured transversely to the longitudinal median axis of the support body or a distance between two outer retaining extensions of a fixing clamp measured transversely to the longitudinal median axis of the support body is longer than the clearance width between the vertical guide arms of the fixing clamp, or in which the width of a retaining extension measured transversely to the longitudinal median axis of the support body substantially corresponds to the width of the mounting zones. Each of this embodiments counteracts any deviating movements of the load-transferring parts of the binding support plate relative to the runner. In particular, the mounting areas for the binding components are prevented from twisting about the binding longitudinal axis. Furthermore, any lifting movements of the support body from the runner top face are counteracted more effectively.

A further embodiment, in which the middle region of the support body lies at least partially in a recess on the top face of a runner, or in which the middle region of the support body or the connecting element thereof is arranged at least partially in a region between the running surface of a runner and the maximum height or thickness of this runner, or in which at least the middle region of the support body lies closer to the region of a neutral fibre of a runner than the two end regions of the support body spaced at a distance apart from one another, is of advantage because at least the middle region of the support body lies closer to the neutral fibres and the neutral zone of the multi-ply runner, thereby affecting its deformation properties even less.

An other embodiment, in which the middle region of the support body is a connecting element of high tensile strength between the mounting blocks and the mounting zones of the support body and has a significantly lower bending stiffness than the distal mounting blocks, or in which the middle region of the support body has the properties of a strip-shaped elements, in particular a high tensile strength, but a low natural stiffness with regard to loads directed perpendicular to a mounting plane for jaw bodies on the support body, is also of advantage because the mounting blocks of the support body are retained at the desired distance whilst at the same time not making the runner very much stiffer, which would be undesirable.

An embodiment, where the support body can be mounted so as to be fixed exclusively at one point relative to the runner, or where a fixed position of the support body relative to a runner lies in a region for receiving a front jaw of a binding unit, guarantees a free-sliding mounting of the binding support plate on the runner.

The embodiment, where in a region of the longitudinal extension, in particular the middle region, of the support body, a longitudinal positioning device is provided for retaining the support body relative to a runner in the longitudinal direction thereof, readily enables the user to stand in various positions relative to the longitudinal extension of the runner.

In an embodiment, in which the longitudinal positioning device accurately retains the support body in position in the longitudinal direction thereof relative to a runner and permits a vertical degree of freedom of the middle region of the support body relative to the top face of a runner, the longitudinal positioning device does not cause any vertical coupling between the runner and the support body, which means that no forced deformation movements are transferred from the runner onto the support body in the region of the longitudinal positioning device if the runner or ski is subjected to bending.

Advantageous embodiments of the longitudinal positioning device also described.

A particularly simple but reliable longitudinal positioning device is achieved, when the longitudinal positioning device is provided in the form of a substantially clearance-free fixing screw inserted through the middle region of the support body, or when a bottom face of the flange of the fixing screw is arranged at a distance above the peripheral region around the orifice for this fixing screw.

As a result of another advantageous embodiment, in which the runner-side retaining member has at least one retaining pin extending perpendicular to the mounting plane or standing plane, which may optionally be displaced in engagement with one of several recesses or orifices arranged at a distance apart from one another in the longitudinal direction of the support body, or in which the support body can be relatively displaced and locked in the longitudinal direction of the runner by means of the retaining member to be fixedly mounted on a runner, the longitudinal position of the support body and the complete binding support plate can be adjusted relative to the runner to suit individual requirements. The travel properties of the runner can be better adapted to soft or hard piste conditions.

A stable mounting for a slide plate, without significantly increasing the stiffness of the support body, is achieved, when the support body has a supporting rib in the region of a sliding plate arrangement for mounting a boot.

Also of advantage is an embodiment, where the support body is split in the middle region and an overlap width of the end regions of the support body parts facing one another may be varied, because adjustments can be made to cater for different boot sizes, starting with the smallest lady's ski boot size up to the largest man's ski boot size, with only one adaptable support body.

The objective of the invention is also independently achieved by a runner, in particular a ski, having several layers between a running surface layer and a top layer forming an integral sandwich unit and the top face of which is designed either to support a binding unit directly or so that a plate-shaped binding support plate can be mounted between the top face of the runner and the bottom face of the binding unit, where at least part regions of a mounting region for a binding unit are three-dimensional in shape or profiled and these profiled part regions of the runner are provided as a means of producing an at least partial positive fit with the bottom face of a binding support plate as previously described.

The advantages gained by the combination of this features reside in the fact a runner of this type, in particular a ski, can be mounted with a support body for a binding support plate which can be of a relatively flexible design but which is nevertheless reliable during travel in terms of capacity to absorb the forces acting on it. Due to the at least partial form fit with the profiled, matching top face of the runner, a support body mounted on this runner proposed by the invention exhibits a high transverse stability and support strength for the jaw body to be mounted on it, in particular for a front jaw and a heel jaw of a binding unit. The support body, which has a relatively low bending resistance moment, advantageously makes the runner hardly any stiffer in the region of the binding mounting, which has a positive effect on the travel and gliding behaviour thereof. This reciprocal form fit also facilitates and simplifies mounting of the corresponding binding support plate.

A runner, where the profiling on the top face is provided by at least one recess running in a longitudinal direction or by means of at last one raised area, fulfils the requirement for a simple longitudinal guide system for the binding support plate. When the binding support plate is duly coupled with the appropriately designed runner, a longitudinal guide system of this type avoids strain between the runner and the binding support plate whenever the runner is deformed. In addition, the binding support plate is very stable in the direction transverse to the runner.

A stable guide arrangement for the binding support plate can be obtained when the profiling is provided as a three-dimensional deformation of the top layer and/or a top surface of the runner.

Another embodiment, where the raised area is provided as a profiled element which can be fixed to the top face, also enables runners with a flat top face to be prepared so that they are suitable for mounting the binding support plate proposed by the invention.

An embodiment, where the profiled element can be screwed onto the top face, enables runners with a flat top face to be adapted retrospectively to allow fitting of the binding support plate proposed by the invention.

Finally, another embodiment, where the raised area is provided by means of at least one screw with a larger screw head which can be anchored in the runner, offers an advantage since it offers a simple approach to providing a guiding and positioning system enabling optimised mounting of the binding support plate proposed by the invention.

BRIEF DESCRIPTION OF THE DRAWINGS

The invention will now be described in more detail with reference to embodiments illustrated in the drawings, wherein.

DETAILED DESCRIPTION OF PREFERRED EMBODIMENTS

Figures 1, 2:
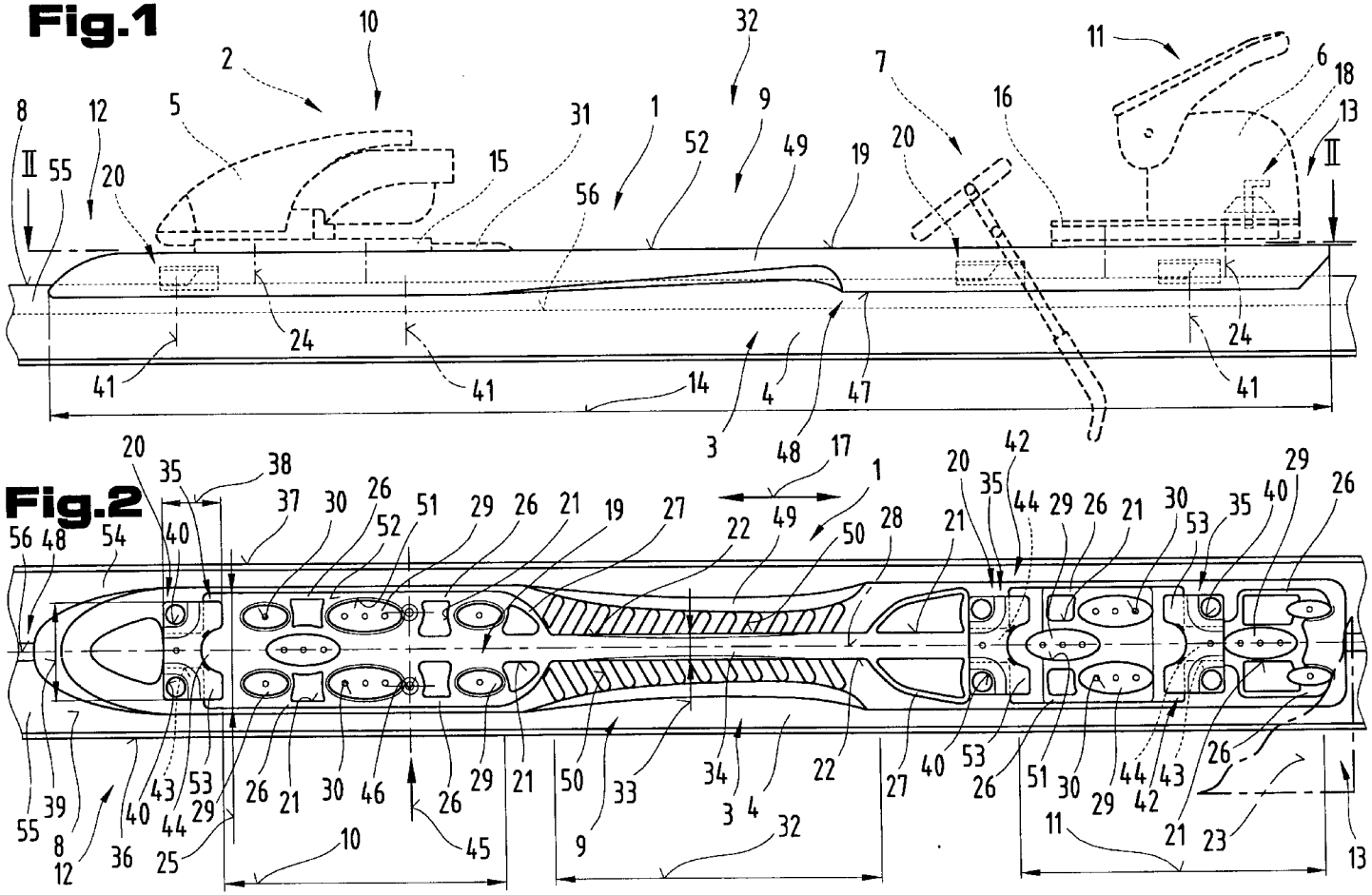
FIG. 1 shows a side view of a binding support plate as proposed by the invention, between a runner, in particular a ski, and a schematically illustrated binding unit.
FIG. 2 is a plan view of the binding support plate and the runner of FIG. 1.
Figures 3, 4, 5:
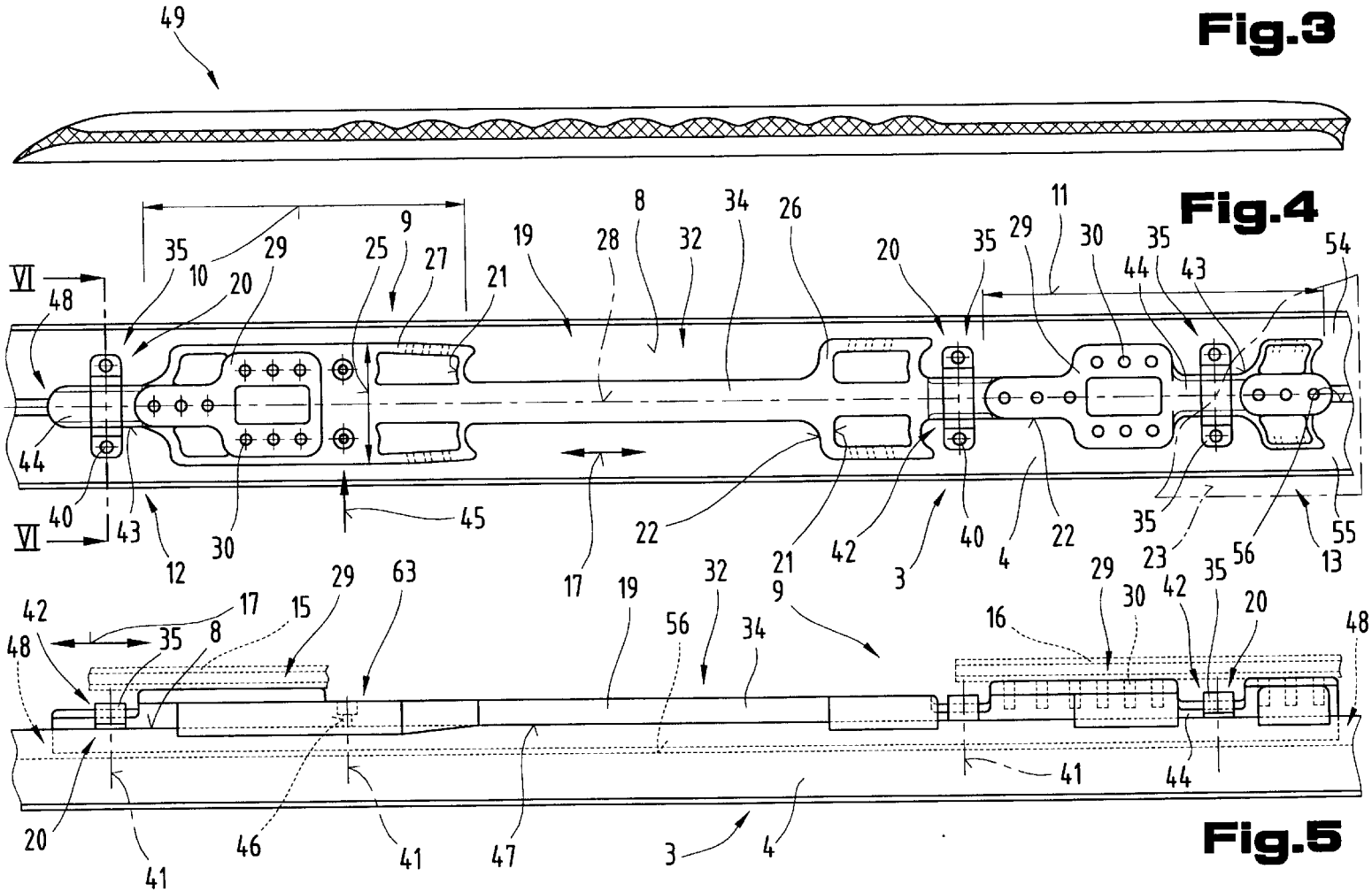
FIG. 3 is a longitudinal section of a cover element for another embodiment of a support body for a binding support plate proposed by the invention and illustrated in FIGS. 4 to 6.
FIG. 4 is a plan view of the support body of the binding support plate proposed by the invention for a runner.
FIG. 5 is a side view of the support body and a runner as illustrated in FIG. 4.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc, relate to the drawing specifically being described and can be transposed in terms of meaning to a new position when another position is being described. Individual features or combinations of features from the different embodiments illustrated and described may also be construed as independent inventive solutions or solutions proposed by the invention in their own right.

FIGS. 1 and 2 illustrate an embodiment of an interface system 1 as proposed by the invention, between a binding unit 2 and a board-type runner 3. The runner 3 is generally a ski 4, preferably an alpine ski as used in pairs of generally standard geometric dimensions and shapes. Accordingly, the binding unit 2 is preferably one of the many designs of safety ski bindings known from the prior art. This being the case, the binding unit comprises two jaw bodies 5, 6, one of the two jaw bodies 5, 6, in particular jaw body 5, being assigned to the toe region and jaw body 6 to the heel region of a boot to be retained, releasably if necessary, on the runner 3. Generally speaking, the binding unit 2 will also have a braking device 7 often referred to as a ski brake, which is preferably assigned to the heel jaw and heel region of a ski boot.

The substantially plate-shaped interface system 1 between a top face 8 of the runner 3 and the bottom face of the binding unit 2 is usually also referred to as a binding support plate 9. In this particular instance, the binding support plate 9 is also a type of adjuster element or adapter between the substantially flat bottom face of the binding unit 2 and its jaw bodies 5, 6 and the preferably profiled or three-dimensionally shaped top face 8 or surface of a runner 3. Consequently, the interface system 1 or binding plate 9 firstly has largely flat mounting zones 10, 11 for the jaw bodies 5, 6 of the binding unit 2. In addition, the user of the system as a whole is also placed in a standing position elevated above the top face 8 of the runner 3 as a result of this binding support plate 9, depending on the dimensions of the interface system 1. This can be of advantage to the travel behaviour of the runner 3. Particularly when travelling round bends when the user is in a more sharply inclined position, this will prevent premature contact of the ski boot with the ground, in particular the piste, underfoot.

The mounting zones 10, 11 for the jaw bodies 5, 6 are respectively provided at distal end regions 12, 13 of the interface system. Accordingly, a length 14 substantially corresponds to a longitudinal extension of the binding unit 2 to be mounted thereon. The length 14 of the interface system 1 is preferably of slightly larger dimensions than the external distance of the two jaw bodies 5, 6 spaced apart from one another.

In the embodiment illustrated as an example here, the mounting zone 10 is provided as a means of attaching a front jaw and the rearward mounting zone 11, spaced apart from it in a normal travelling direction of the runner 3, as a means of retaining a heel jaw of a binding unit 2. Only one or alternatively both of these jaw bodies 5, 6 can be screwed fast and directly to the interface system 1 at a distance corresponding to the desired boot size.

By preference, however, at least one of the jaw bodies 5, 6 is retained in a known manner in matching guide tracks 15 and/or 16. These guide tracks are preferably provided in the form of metal sections of a substantially C-shaped, hat-rail-shaped or open square-shaped cross section. Instead of using separate guide tracks 15, 16, it would also be possible to design these guide tracks 15, 16 as an integral element of the interface system 1. If using high-strength materials, these guide tracks 15, 16 may also be provided as an integral unit with the interface system 1.

Accordingly, by guide tracks 15, 16 is meant any longitudinal guiding system between a jaw body 5, 6 and the interface system 1.

The guide tracks 15, 16 or equivalent guiding systems enable the entire binding unit 2 to be adjusted or only one of the two jaw bodies 5, 6 relative to the interface system 1 along longitudinal direction—as indicated by the double arrow 17.

In a preferred, although not restrictive embodiment, the front jaw body 5 is screwed to the interface system 1 so as to be stationary and the heel jaw is connected to the rear jaw body 6 by means of a flexible but non-expandable connecting element. This rear jaw body 6 is therefore slidably mounted in the guide track 16 co-operating therewith so that the runner 3 and/or the interface system 1 is able to effect longitudinal compensating movements in the longitudinal direction—indicated by double arrow 17—of the runner 3 as and when deformations occur relative to the rear jaw body 6 during travel. However, because of the special design of the interface system 1, described in more detail below, it is no longer absolutely necessary to provide a so-called free-sliding binding unit 2 and instead—as explained above—it is also possible to secure the jaw bodies 5, 6 fast and to provide an appropriate locking device 18 co-operating with at least one of the jaw bodies 5, 6 in order to adapt to different boot sizes, by means of which the jaw distance can also be readily altered by an end user and preferably without the aid of tools, without the inconvenience of having to undertake screwing operations.

The complete interface system 1 or binding support plate 9 essentially comprise three basically functional components. This is particularly so in the case of a support body 19, which, in conjunction with special fixing means 20, constitutes the main load-transmitting means between the binding unit 2 and the runner 3. By preference, several fixing means 20 are provided, spaced apart from one another in a longitudinal direction—double arrow 17—by means of which the support body 19 is secured to a runner 3.

The support body 19 itself is a component with a sufficiently high compression strength. The support body 19 is nevertheless more flexible than the board-type runner 3, in particular the ski, by a multiple in its mounting region for the interface system 1 or the binding unit 2. The support body 19 is preferably designed as an elongate, plate-type moulded component, with a plurality of orifices 21 and/or slits 22.

These orifices 21 and/or slits 22 in the plate-type support body 19 serve as deliberately provided weaker points for the support body 19. These weakened regions in the support body 19, which may also be provided in the form of recesses and/or by blind-bore type cut-away areas in the relatively hard material of the support body 19, which is resistant to breaking under the loads to which it is subjected, advantageously increase the bending capacity or flexibility of the support body 19. In particular, depending on the material used or the inherent nature of the material, the natural stiffness of the compression-resistant or dimensionally stable material from which the support body 19 is made is perceptibly reduced as a result of the aforementioned features.

The orifices 21 and/or slits 22 and/or material weaknesses or slits in the support body 19 therefore reduce its bending resistance when pressure is directed perpendicular to a mounting plane 23 for the binding unit 2, without essentially making the schematically illustrated fixing screws 24 for the jaw bodies 5, 6 and/or their guide tracks 15, 16 any more susceptible to being torn out of the material of the support body 19, which would otherwise be a disadvantage.

The orifices 21 and/or slits 22 in the longitudinally extending support body 19 form relatively narrow webs 26 and/or supporting ribs 27 in some part regions of the support body 19 compared with a largest width 25 thereof. Relative to the longitudinal direction—indicated by double arrow 17—the orifices 21 and/or slits 22 are preferably arranged symmetrically in pairs. Furthermore, the individual pairs of these recesses in the support body 19 are spaced apart from one another in the longitudinal direction—indicated by double arrow 17. Alternatively or in combination therewith, it would also be possible to provide several orifices 21 and/or slits 22 or material weaknesses on either side of a longitudinal median axis 28. Similarly, it would also be possible to provide these orifices 21 and/or slits 22 in the support body 19 centrally to the longitudinal median axis 28. By preference, these orifices 21 and/or slits 22 are also provided in at least one of the mounting zones 10, 11 for the jaw bodies 5, 6. These orifices 21 and/or slits 22 may also be arranged immediately adjacent to anchoring zones 29 for the fixing screws 24 of jaw bodies 5, 6 or other functional elements of a binding unit 2. Accordingly, for example, orifices 21 and/or slits 22 might be provided in front of and behind an anchoring region 29 for a fixing screw 24 relative to the longitudinal direction—indicated by double arrow 17—as can be seen more particularly in mounting zone 10.

At least one bore 30 is preferably provided in the anchoring zones 29 of the support body 19. Appropriate fixing screws 24 for the binding unit 2 can then be screwed into these bores 30, which ideally will have already been provided by the manufacturer, thereby anchoring the binding unit 2 in the interface system 1. The bore layout for the bores 30 in the mounting zones 10, 11 is selected so that a plurality of different binding types can be fitted and/or different boot sizes can be catered for. The anchoring zones 29 with bores 30 for fixing screws 24 constitute the main points at which force is transmitted between a binding unit 2 and the transition system 1 and vice versa.

The length or penetration depth of the fixing screws 24 and the thickness of the anchoring zones 29 is selected so that the binding unit 2 is anchored exclusively in the anchoring zones 29 and only in the support body 19. However, care should be taken to ensure that the fixing screws 24 for the binding unit 2 are not able to penetrate the actual runner 3, as schematically illustrated by the fixing screws 24.

The fixing screws for other functional elements of the binding unit, e.g. for the braking device 7 or for a slide plate arrangement 31, are also dimensioned so that they do not penetrate the top face 8 of the runner 3 but are retained in a load-bearing arrangement exclusively in the support body 19.

Between its distal mounting zones 10, 11, the support body 19 preferably has a middle region 32 of a tapering design, the surface areas of which essentially correspond in size to the support surfaces of the jaw bodies 5, 6 and/or their guide tracks 15, 16. The support body 19 is therefore preferably narrower at its middle region 32 than at its two end regions 12, 13. In particular, the support body 19 has a width 33 in the middle 32 which is only a fraction, in particular approximately one fifth to approximately one half, the width 25 of the support body 19 at its end regions 12, 13. These judiciously positioned, peripheral slits 22 in the middle region 32 of the support body 19 significantly reduce its bending resistance moment and the support body 19 placed on the runner 3 affects the runner 3 no more than the most negligible "foreign body" would. In particular, by using a support body 19 of this type, the runner 3 is subjected to hardly any detrimental effects in terms of its inherent bending stiffness behaviour.

These tapered areas in the middle region 32 of the support body 19 therefore help to retain the bending elastic deformation properties built into the runner 3 by the manufacturer to the optimum degree. In addition to the mounting or retaining system used for a support body 19, the structural design and the material used for a support body 19 are therefore also key factors of the resultant bending resistance moment of the support body 19.

Preferably, the support body 19 therefore has a slim, skeletal-type structure. Considered symbolically—as may best be seen from the plan view given in FIG. 2—the peripheral contour of the support body 19 is essentially of a dog-bone or dumb-bell design characterised primarily by a middle region 32 that is distinctly more tapered than the end regions 12, 13 of the preferably integral support body 19.

In a preferred embodiment, the support body 19 is made from a plastics material, in particular a hard plastics material such as POM for example. Accordingly, the support body 19 is preferably made as a single injection-moulded part. Clearly, however, any other materials with a high capacity to retain fixing screws 24 without them tearing out could also be used without departing from the scope of the invention. This being the case, the support body 19 could also be made from metallic materials, in particular light metals. Aluminium alloys, such as a titanium-aluminium alloy, might be considered for this purpose amongst others. Similarly, the support body 19 could be made from a combination of different materials and/or fibre-reinforced, in particular glass-fibre or carbon-fibre-reinforced plastics.

Instead of using a single-piece support body 19, it is also possible to provide a multi-part, for example a two-part or three-part support body 19. For example, it would be conceivable to provide the middle region 32 as a separate component. This being the case, the middle region 32 could also be made from a relatively thin, strip-shaped connecting element 34 of a plastics material or metal. This connecting element of a low structural stiffness but with a sufficiently high tensile strength will then connect the front and rear plate part forming the mounting zones 10, 11. In this instance, the sole purpose of the connecting element 34 is to ensure that the predefined distance between the front and rear plate parts, in particular the distance between the front mounting zone 10 and the rear mounting zone 11, is maintained.

The fixing means 20 by means of which the support body 19 is mounted on a corresponding runner 3 are also key components of the interface system 1.

The fixing means 20 are provided in the form of at least one fixing clamp 35. By preference, several fixing clamps 35 are provided, spaced apart from one another in the longitudinal direction—as indicated by double arrow 17—of the support body 19. The fixing clamps 35 run substantially transversely to the longitudinal axis—indicated by double arrow 17—of the support body 19 and transversely to the binding longitudinal axis and do so extending in a bridge arrangement across part regions of the support body 19. The fixing clamps 35 therefore run transversely to the longitudinal axis—indicated by double arrow 17—of the support body 19 from a first longitudinal edge region 36 to a longitudinal edge region 27, lying opposite, of a runner 3, in particular a ski 4. These fixing clamps 35 are separate components, basically independent of the support body 19. A width 38 of these fixing clamps 35 running transversely to the runner 3 is only a fraction of the longitudinal extension of the mounting zones 10, 11, in particular approximately 1 cm to approximately 5 cm. A length 39 or bridging width of the fixing clamps 35 as measured transversely to the longitudinal axis—indicated by double arrow 17—is from approximately 3 cm to more or less the width of the runner 3 in the binding mounting region, i.e. approximately up to a maximum of 10 cm. In the end regions of the bracket-shaped fixing clamps 35 relative to its length 39, orifices 40 or peripheral slits are provided for receiving other, separate fixing screws 41. These fixing screws 41 screwed vertically into the fixing clamps 35 secure the fixing clamps 35 firmly to the top face 8 of a runner 3. In particular, the fixing clamps 35 are screwed, firmly or with some play, to the runner 3 by means of the other fixing screws 41, any pre-tensioning being determined by the degree to which the screws are tightened.

At least a part region of the support body 19 runs through and underneath the fixing clamps 35 and the support body 19 is therefore secured, at least in the immediate region around the fixing clamps 35, to prevent it from lifting off the top face 8 of the runner 3. These fixing clamps 35 are primarily arranged in the immediate region around or adjacent to the anchoring zones 29 or the mounting zones 10, 11 for the jaw bodies 5, 6. As shown in the example illustrated as an embodiment here, only one fixing clamp 35 is provided immediately in front of the foremost anchoring zones 29 of the mounting zone 10. At the rear mounting zone 11 for jaw 6, two fixing clamps 35 are provided, one of the fixing clamps 35 being arranged at the centre of the mounting zone 11 for jaw 6 and the other fixing clamp 35 being positioned in the front end region of the mounting zone 11. The fact that the fixing clamps 35 are laid out in the narrowest possible arrangement from the anchoring zones 29 where force is transmitted directly between jaw bodies 5, 6 and the support 19 is therefore an essential factor. This more or less adjacent positioning of the fixing clamps 35 relative to the anchoring zones 29 is important because, in spite of the fact that the support body 19 has a relative low natural stiffness, a high retaining force for the jaw bodies 5, 6 on the runner 3 is obtained and permits barely any shifting of the support body 19 at all relative to the top face 8 of the runner 3.

The shape of the fixing clamps 35, in particular their internal contour, conforms, at least in part regions, to the external contour of the support body 19 in each fixing region. By preference, the inner face or the side of a fixing clamp 35 facing the support body 19 complements the external contour of the support body 19 in each fixing region. It has been found to be particularly practical if the support body 19 is of a rectangular, in particular square or trapezoid shape or alternatively bent to an arcuate shape in cross section in its fixing regions. Once screwed to the runner 3, the bottom face of each fixing clamp 35 conforms to the external contour of the support body 19, as far as possible with no clearance, and therefore prevents any deflecting movements of the support body 19 relative to the runner 3 transversely to the longitudinal direction—as indicated by double arrow 17. However, the key factor is that the fixing clamps 35 permit a relative adjustability of the support body 19 in its longitudinal direction relative to the runner 3, if the runner 3 is deformed, in particular flexed.

The fixing clamps 35 mounted fast on the ski therefore form a longitudinal guide device 42 for the support body 19 relative to the runner 3. This longitudinal guide device 42 allows only compensating movements between the support body 19 and the runner 3 when the latter is flexed. Any other degrees of freedom, in particular all transverse movements perpendicular to the longitudinal median axis of the support body 19, are largely prevented by this longitudinal guide device 42. A standard guide length between the support body 19 and the fixing clamps 35 is several tenths of a mm up to approximately 5 mm and will primarily depend on the degree of deformation in the runner 3 and will depend on the fixing positions of the fixing clamps 35 and the selected measuring point. Compensating paths of this type can be easily provided by appropriate free areas or recesses between the fixing clamps 35 and the surrounding regions of the support body 19.

Also in the region of the fixing clamps 35, in other words in the fastening regions to the runner 3, the support body 19 has indentations 43 or regions which are tapered compared with its largest width 25 in the mounting zones 10, 11. A width of a remaining connecting web 44 of the support body in its fixing regions is only a fraction, in particular approximately one fifth to approximately one half, of the width 25 of the support body 19 in the mounting zones 10, 11. As a result, the other fixing screws 41 can be screwed into the runner 3, also perpendicular to the mounting plane 23 for the jaw bodies 5, 6. In particular, this also enables the fixing screws 41 for the fixing clamps 35 to be screwed into the top face 8 of the runner 3, thereby ensuring a high degree of resistance to prevent them from being torn out.

Alternatively, it would also be conceivable to anchor the fixing screws 41 into the side cheeks of the runner 3 or ski 4. In this case, the fixing clamps 35 will extend as far as the side cheek regions, in which case it is absolutely crucial for the support body 19 to be elevated in the fixing region.

In the example illustrated as an embodiment here, the fixing clamps 35 are basically of a hat-rail shape and the end regions of these fixing clamps 35 sit on the top face 8 of the runner 3 without any clearance once they are mounted.

In the region of the longitudinal direction—indicated by double arrow 17—of the interface system 1, the support body 19 is therefore individually retained, as, optionally, are irregularly disposed longitudinal guide devices 42, formed in particular by the individual fixing clamps 35, so that it can move in a sliding action on the top face 8 of the runner 3. Accordingly, the support body 19 or the entire binding support plate 9 is preferably coupled with the runner 3 at only a single fixed position 45, so as to remain absolutely fixed or rigid therewith in movement. By fixed is meant that the support body 19 or the interface system 1 is coupled with the top face 8 of the runner 3 so as to be as far as possible rigid and non-slidable in all spatial directions. In the embodiment illustrated as an example here, this fixed position 45 of the support body 19 is provided in the end region of the front mounting zone 10 facing the middle region 32. As will be explained in more detail below, this fixed position 45 may also be arranged centrally relative to the support body 19 and in the middle region 32 of the interface system 1. Similarly, it would also be conceivable for this fixed position 45 to be provided in one of the end regions 12, 13 or in the region of the rear mounting zone 11. The fixed position 45 of the support body 19 relative to the runner 3 is preferably obtained by means of at least one, and in the embodiment illustrated as an example here, two fixing screws 41 which are inserted through at least one bore 46 in the support body 19, pushing the latter against the top face 8 of the runner 3 in a more or less positive fit. At this fixed position 45, the specific capacity of the support body 19 to slide in its longitudinal guide devices 42 is essentially disabled when the runner 3 is in the force-free state and in the non-operating state. Only when the runner 3 is subjected to vertical bending stresses, in particular when the runner 3 is subjected to positive and/or negative flexing, does the design of the longitudinal guide device 42 and the fixing clamps 35 come into play in a supporting function. A relative sliding action does not occur between the support body 19 or interface system 1 and the runner 3 until the runner 3 is subjected to these vertical bending stresses. These relative sliding movements are naturally at their greatest in the end regions 12, 13 of the binding support plate 9 and the requisite longitudinal compensation between the runner 3 and the support body 19 increases the greater the distance from the fixed position 45.

In the interface system 1 proposed by the invention, it is also crucial that a bottom face 47 of the support body 19 facing the runner 3 is able to engage in a positive fit with a profiled top face 8 of a runner, as is best illustrated in FIG. 1. The positive coupling between the top face 8 of the runner 3 and at least some part regions of the support body 19 and the binding support plate 9 is particularly conducive to improving the strength or dimensional stability of the connection between the interface system 1 and the runner 3. The crucial factor is that because of the at least partial positive fit between the regions of the support body 19 and the runner 3 facing one another, a support body 19 is obtained which has a relative low natural stability and dimensional stability compared with conventional support plate arrangements. As a result of the at least partial positive connection between the support body 19 and the runner 3, this essentially low natural stiffness of the support body 19 and of the entire interface system 1 is not detrimental to the stability of the binding unit 2 and accordingly doe snot impair the travel properties. On the contrary, test measurements have shown that the bending curve of the runner 3 remains essentially unchanged even once the interface system 1 has been assembled and the runner 3, in particular the ski 4, is barely affected at all in terms of the deliberate properties incorporated by the design of the manufacturer, providing an overall harmonious bending curve. The almost arcuate course of the bending curve therefore remains largely unchanged even after the interface system 1 has been mounted on the runner 3 and the properties in terms of travel dynamics or the gliding and guiding properties of the runner 3 are almost ideal even after a ski boot has been placed in the binding unit 2.

The way in which this positive connection between the bottom face 47 of the support body 19 and part regions of the top face 8 of the runner 3 can be produced will be explained in more detail below.

The essential factor is that this positive engagement between the support body 19 and the runner 3 is designed in such a way that the support body 19 and the runner 3 can be guided in a relative displacement to one another in the longitudinal direction—indicated by double arrow 17. The positive fit mentioned above is therefore such that the bottom face 47 of the support body 19 connected to the top face 8 of the runner 3 constitutes another, separate longitudinal guide device 48. This longitudinal guide device 48 between the support body 19 and the runner 3 permits relative sliding movements between the aforesaid parts in a longitudinal direction—indicated by double arrow 17—of the support body 19 but prevents any deflecting movements transversely to the longitudinal direction—indicated by double arrow 17—and more or less parallel with the mounting plane 23, as far as possible without any clearance. The longitudinal guide device 48 aligned parallel with the longitudinal path of the support body 19 therefore permits compensating movements between the support body 19 or between the interface system 1 and the runner 3 in both vertical directions, upwards and downwards, as the runner 3 is deformed.

Consequently it is essential that at least a bottom part region of the binding support plate 9 which will face a runner 3 and which will afford a sufficient guiding stability and guiding accuracy in the longitudinal direction—indicated by double arrow 17—is able to engage at least partially in intermittent complementary profiled areas on the top face 8 of the runner 3. The top face 8 of the runner 3 and hence the sections of the support body 19 which engage with it should therefore be of a dimensional stability or hardness and reciprocal fitting accuracy such as to ensure that there can be no lateral deviating movements of more than 3 mm.

In a preferred embodiment, the interface system 1 or binding support plate 9 also has a cover element 49 which overlaps or encloses the frame—and bearing frame-like support body 19, at least in certain regions. This cover element 49 is primarily what determines the overall appearance of the entire binding support plate 9 and interface system 1. By preference, the cover element 49, which is what determines the overall visual appearance of the binding support plate 9, is made from a single piece. Clearly, it would also be possible to provide several cover elements 49, in which case each cover element 49 would be assigned to specific sections of the support body 19, making it possible, for example, to cover or mask only the regions around the fixing clamps 35. Similarly, it would also be conceivable to arrange several cover elements 49 connected to or overlapping with one another in order to produce an attractive visual appearance on the one hand and to provide an easy means of catering for different sizes and types of support body 19 on the other.

In the embodiment illustrated as an example here, the cover element 49 is provided in the form of a covering hood on top of the load-bearing support body 19 responsible for transmitting forces.

In the embodiment illustrated, the cover element 49 is made from a partially transparent plastics material of the desired colour or colour combination. Transparent plastics materials may be used so that the designs lying underneath are visible, thereby imparting an interesting appearance. In the diagram shown in FIG. 2, the underlying fixing clamps 35 and the support body 19, illustrated schematically, are visible. Clearly, it would also be possible to make the cover element from a non-transparent or opaque material, in particular a plastics material.

The cover element 49 is preferably made from plastics by an injection moulding process and is totally flexible compared with the runner 3. The high elasticity or relatively soft body of this cover element 49 means that the cover element 49 can be made to fit the mostly profiled top face 8 of the runner 3 in an attractive mounting. Since the elastic cover element 49 is able to compensate for a certain degree of inaccuracy in terms of shape and fit, the parts lying underneath the cover element 49, in particular the support body 19 and the fixing clamps 35, are clearly partitioned off from the region surrounding the interface system 1 as a whole. As a result, ice or snow is safely prevented from getting between the cover element 49 and the top face 8 of the runner 3 as far as possible and the interface system 1 will continue to function as correctly as possible, even under the most adverse conditions.

In the middle region 32 in particular, the cover element 49 may also have recesses in the material 50, slits, dimples or similar in order to keep the bending resistance moment of the cover element 49 as low as possible.

Accordingly, the cover element 49 hardly contributes to the overall stability of the binding support plate 9 at all and if it does, it does so only to a relatively slight degree.

Particularly if the cover element 49 is made from a plastics material with elastomeric properties, at least those sections of the cover element 49 co-operating with the mounting zones 10, 11 for the jaw bodies 5, 6 will have recesses or will be slightly loose or thin-walled. In the embodiment illustrated as an example here, the anchoring zones 29 provided on the support body 19 standing up in a block-type design are inserted directly through the cover element 49. To this end, cut-outs 51 may be provided at least in part regions of the cover element 49, through which sections of the mounting zones 10, 11, in particular the anchoring zones 29, can be inserted so as to sit flush with a surface 52 of the cover element 49.

Instead of providing cut-outs 51 or holes in the cover element 49 the cover element 49 could be designed to be thinner in those regions in which force is to be transmitted between the jaw bodies 5, 6 and the support body 19 so that the flexibility of the cover element 49 is largely eliminated in these force-transmitting zones. Making the material of the cover element 49 thinner in the respective regions at which force is transmitted has an advantage over providing cut-outs 51 in the cover element 49 because the support body 19 and the fixing screws 41 or the core component of the runner 3 will be effectively protected against any ingress of moisture which might otherwise occur.

The connecting webs 44 of the support body 19, which are bridged by the fixing clamps 35 secured to the runner 3 without any clearance as far as possible are—as mentioned above—of a relatively narrow design compared with the width 25 of the mounting zones 10, 11 of the support body 19. In order to secure the mounting zones 10, 11 so that they are prevented as far as possible from twisting on the runner 3 relative to a binding longitudinal axis, at least some of the fixing clamps 35 have retaining extensions 53. These retaining extensions 53 overlap the peripheral region of the mounting zone 10 and/or 11 facing them. As a result, the mounting zones 10, 11 are effectively prevented from tilting about the longitudinal axis—indicated by double arrow 17—of the support body 19 and about the binding longitudinal axis. To this end, in the direction extending perpendicular to the mounting plane 23, the shoulder-like retaining extensions 53 sit with the mounting zones 10, 11 substantially without any clearance against the plate-like elements. Regions between the connecting web 44 and the adjoining mounting zone 10 and/or 11, which are wider or larger in surface area relatively speaking, are therefore overlapped by the retaining extensions 53. As a result, the mounting zones 10, 11 and the plate sections are prevented from lifting on one side from the top face 8 of the runner 3. Accordingly, even if relatively high torsional forces are applied by the jaw bodies 5, 6 to the support body 19, this arrangement prevents one of the jaw bodies 5, 6 from tilting about the binding longitudinal axis—indicated by double arrow 17. In particular, even under high loads such as would primarily occur when travelling rapidly round bends, force can be transmitted to the runner 3 in the most direct way possible and without delay, ensuring that the runner 3 is controlled in a selectively accurate and calculable manner.

The retaining extensions 53 or overlaps between the fixing clamps 35 and the plate parts for the mounting zones 10, 11 are therefore selected so as to maintain the capacity for longitudinal compensation in the longitudinal guide devices 42 and/or 48.

By preference, the overlap region between the retaining extensions 53 of the fixing clamps 35 and the plate parts with the substantially flat support surfaces formed by the mounting zones 10, 11 are disposed deeper than the mounting plane 23 for the jaw bodies 5, 6 and deeper than the plane of the anchoring zones 29 supporting a binding unit 2.

FIGS. 3 to 6 illustrate an embodiment of the binding support plate 9 and interface system 1 as proposed by the invention that is slightly different from the embodiment described above, the same reference numbers being used to denote same components. The description given above can therefore be transposed in terms of meaning to same parts denoted by the same reference numbers.

Here too, the binding support plate 9 or interface system 1 essentially comprise a slim, frame-type, elevated support body 19, which can be mounted by means of clamp-type fixing means 20 on a board-like runner 3, in particular a ski 4. In the direction perpendicular to the horizontal mounting plane 23, this ribbed-design support body 19 has the lowest possible bending resistance moment for a ski binding. To this end, the essentially flat or plate-like support body is provided with a plurality of orifices 21 and/or slits 22 and/or areas of reduced cross sections or cut-outs in the material. The mounting zones 10, 11 and the end regions 12, 13 of the support body 19 are wider or larger in surface area than the other sections or regions of the support body 19, especially the middle region 32 of the support body 19.

A part region of the bottom face 47 of the support body 19 engages with certain areas of the profiling on the top face 8 of the runner 3 in a positive fit, this complementary profiling between the support body 19 and the runner 3 constituting a longitudinal guide device 48 in the longitudinal direction—indicated by double arrow 17—of the runner 3, which permits longitudinal compensating movements between the support body 19 or interface system 1 as a whole and the runner 3 when the latter is subjected to flexing and/or counter-flexing. The support body 19 is again secured so that it is fast with the runner 3 at only one fixed position 45 in all spatial directions. The end regions 12, 13 of the support body 19 spaced at a distance from the fixed position 45, on the other hand, are fastened to the runner 3 by fixing clamps 35 but can still be displaced in the longitudinal direction—indicated by double arrow 17—in a sliding movement relative thereto whenever the ends of the runner 3 flex up and down relative to the middle region thereof.

The connection between the support body 19 and the runner 3 may be likened to a leaf spring assembly of the type where several leaf springs are arranged one above the other and joined to one another at a single point, namely in the middle region, by means of a dog bolt but so that the end regions of the leaf springs are still able to slide relative to one another to produce the desired biasing and damping effect of the leaf spring arrangement.

This support body 19, which looks rather like filigree, assumes the function of transferring all the force between jaw bodies of a binding unit and the runner 3. The loading capacity of the support body 19, which is nevertheless high, is obtained firstly due to the fact that the fixing clamps 35 are disposed in the region immediately around or within the mounting zones 10, 11 for the jaw bodies and the support body 19 engages at least partially with profiling on the top face 8 of the runner 3, essentially enabling it to support a high degree of force in those regions, thereby producing a stable overall assembly.

This relatively fissured support body 19, which might appear to be unstable if viewed superficially, may also be covered with a cover element 49 which will essentially determine how the ready-to-use interface system 1 will look. The primary function of the cover element 49 for the support body 19 is to determine the visual appearance of the interface system 1 and protect the support body 19 from coming into direct contact with ice or snow. The cover element 49 therefore has barely any or very little influence on the stability or resistance values of the interface system 1 overall. Being the main design element of the interface system 1, the cover element 49 may have substantially flat zones, particularly at its end regions, for receiving guide tracks or jaw bodies of a binding unit and may have ribs, slits, recesses or similar in the middle region, extending at an angle for example.

Figure 6:
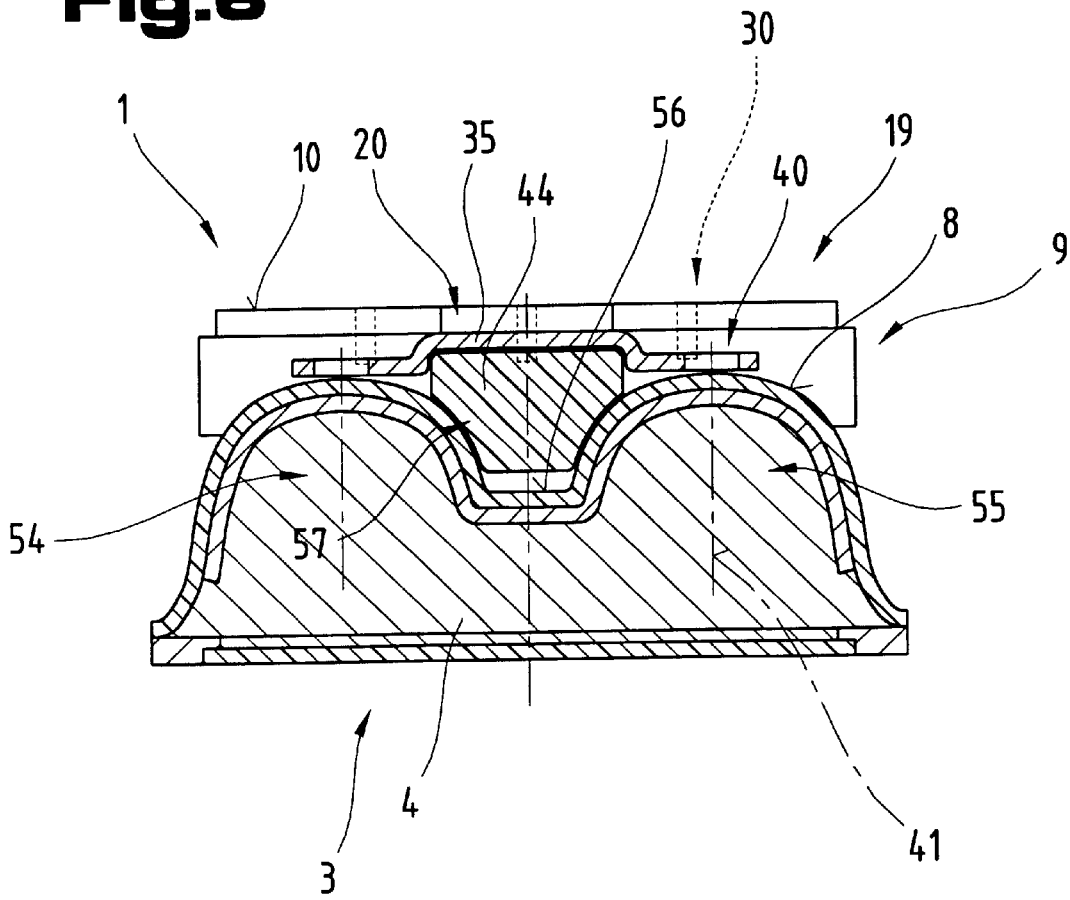
FIG. 6 is a view of the support body and a runner, shown in section along the lines VI—VI of FIG. 4.

The longitudinal guide device 48 between the support body 19 and the surface-profiled runner 3 is best illustrated in FIG. 6. In one advantageous embodiment, the runner 3 has on its top face 8, two bead-shaped raised areas 54, 55, for example, with a recess 56 lying in between. These raised areas 54, 55 and this recess 56 extend substantially across the entire length of the runner 3, in other words including within the mounting region for a binding and for the interface system 1.

Instead of using an embodiment with surface-profiling as described above, the runner top face could be of any other shape that would permit a positive fit coupling capable of acting as a guide means between the interface system 1 and the runner 3. Rather than providing raised areas 54, 55 with a curved, arcuate cross section, it would also be possible to use raised areas 54, 55 of an essentially trapezoid shape, in which case the recess 56 in between would be used to provide a slidable mount or support for the interface system 1 and the support body 19.

From this drawing, it is evident that the surface-profiling of the runner 3, in particular the recess 56 thereof, in co-operation with the clamp-type fixing means 20, in particular the fixing clamp 35, virtually form a guide passage 57 for the support body 91 and for its connecting web 44. As clearly illustrated in the drawing of FIG. 6, the support body 19 is of a design adapted to match exactly and in terms of extension the profiling of the top face 8 of the runner 3, at least in the region underneath the mounting zones 10, 11 for the jaw bodies of a binding unit. In particular, at least in these regions of the mounting zones 10, 11, the bottom face 47 of the support body 19 is designed to complement the profiling of the runner top face. These regions of the support body 19 therefore serve as a sort of adapter to the design of a flat-surfaced mounting zone 10, 11 on the runner 3 with its profiled top face 8. In addition, as clearly illustrated, the mounting zones 10, 11 are designed so that they stand proud of the surrounding part regions of the support body 19 in a mounting block arrangement. A top face of the fixing clamps 33 abuts with the mounting zones 10, 11 at least flush or preferably sits slightly below the horizontal plane forming the mounting zones 10, 11.

Figures 7, 8:
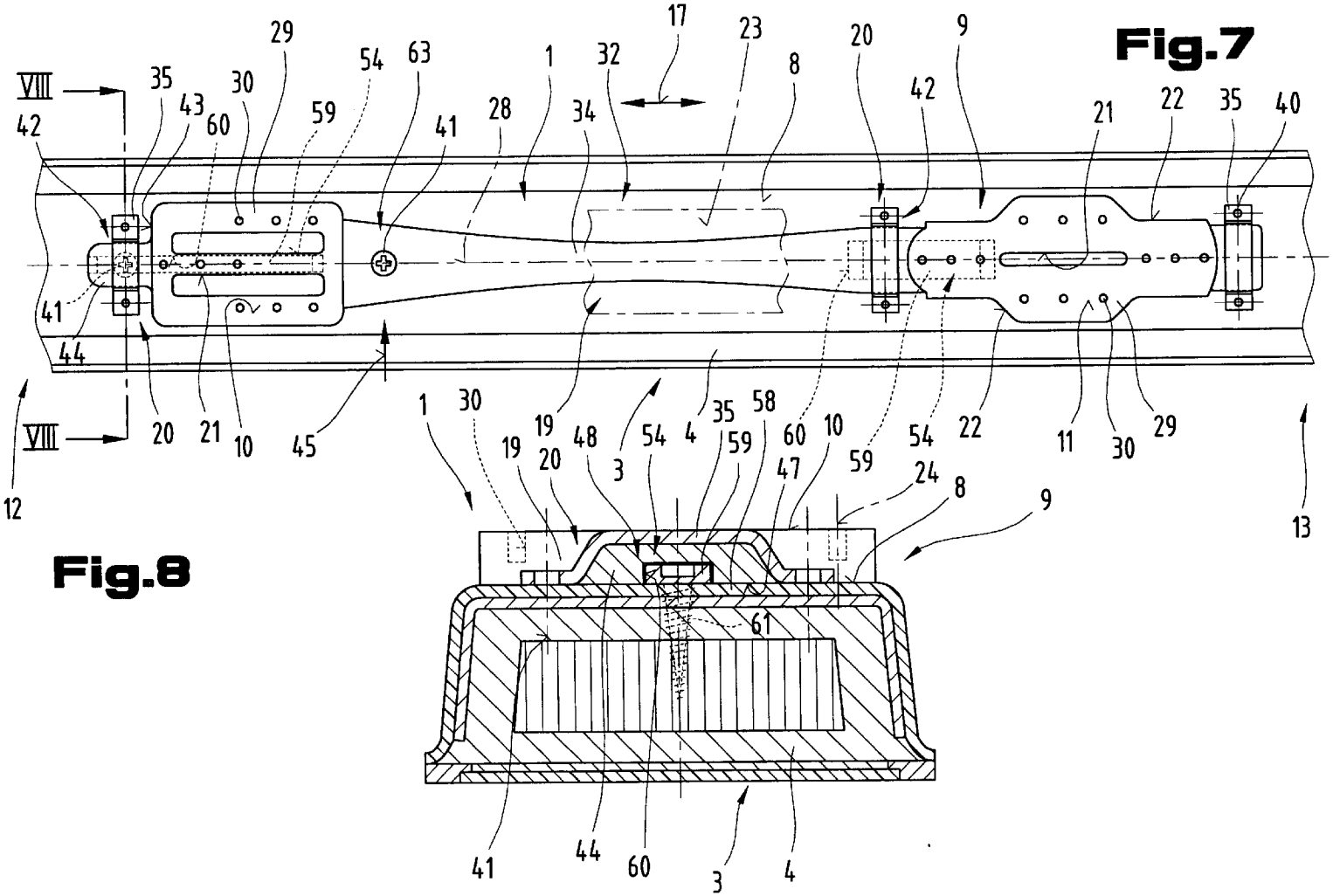
FIG. 7 is a plan view of another embodiment of the binding support plate proposed by the invention without cover element.
FIG. 8 is a view of the support body of the binding support plate mounted on a ski, seen in section along the lines VIII—VIII of FIG. 7.
Figures 9, 10:
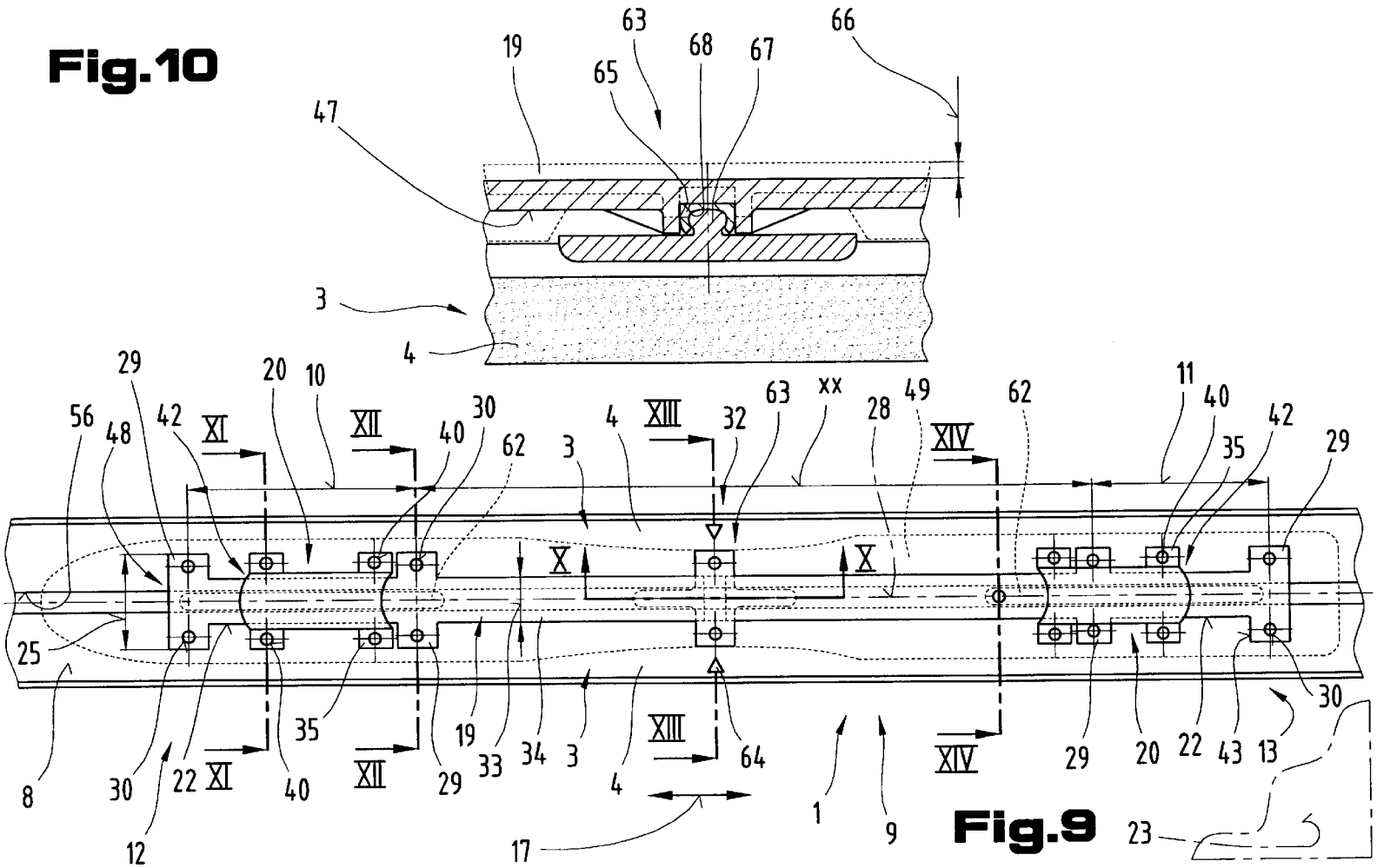
FIG. 9 is a plan view of another embodiment of a binding support plate proposed by the invention with a schematically illustrated cover element.
FIG. 10 FIG. 10 shows a longitudinal positioned system for the support body in conjunction with a vertical guide system, seen in section along the lines X—X of FIG. 9.

FIGS. 7 and 8 illustrate another embodiment of an interface system 1 or binding support plate 9 assembled on a runner 3 as proposed by the invention. Where the structure is essentially the same as that described above, the same reference numbers as those above are again used to denote some parts in the description of this embodiment and the relevant sections of the description given above can be transposed in terms of meaning to the same parts bearing the same reference numbers.

The essential difference of this design is the fact that the support body 19 in this case co-responds to or co-operates with a raised area 54 on the top face 8 of the runner 3. This raised area 54 may be provided either by means of a top layer 58 and/or top surface of the runner 3 of an appropriate shape or the raised area 54 is provided as a separate profiled element 59 which is joined, in particular bonded, screwed, locked or otherwise secured, to the top face 8.

In the embodiment illustrated as an example here, the profiled element 59 is essentially rectangular in cross section and is secured to a runner 3 by means of screws, for example, on the substantially flat top face 8. The runner 3 with its flat top face 8 and more or less trapezoidal cross section therefore has a raised area 54 once the profiled element 59 is mounted on the top face 8. This profiled element 59 may extend end-to-end across the entire binding mounting region of the runner 3 or, as illustrated in FIG. 7, may be provided across a certain section only. By preference, this raised area 54 or the profiled element 59 is provided at least in the region of the mounting zones 10, 11.

The raised area 54 or profiled element 59 engages at least partially in a complementary recess 60 or in an orifice of appropriate dimensions in the support body 19. A width of this recess 60 as measured transversely to the longitudinal direction—indicated by double arrow 17—corresponds more or less to a width of the raised area 54 or the profiled element 59 so that there is barely any room for movement in the transverse direction. However, the longitudinal dimensions and layout between the raised area 54 or profiled element 59 and the recess 60 on the bottom face 47 of the support body 19 are selected so that a longitudinal guide device 48 is formed in the longitudinal direction—indicated by double arrow 17—which will afford a sufficient compensating path between the support body 19 and the runner 3 when the latter is deformed, thereby allowing a certain degree of deformation in the support body 19. The maximum compensating path needed between the support body 19 and the runner 3 in the longitudinal direction—indicated by a double arrow 17—of the runner 3 is approximately 6 mm as a rule but essentially depends on the distance to the fixed position 45 relative to the runner 3.

The raised area 54 or profiled element 59 on the runner side preferably also extends underneath the clamp-type fixing means 20, as is most clearly illustrated in FIG. 7. These profiled elements 59 fast with the ski may therefore be provided from the outset at the manufacturing stage or alternatively may be supplied as a component of the interface system 1 so that the interface system 1 proposed by the invention can also be mounted on runners 3 or skis 4 of any type by the dealer or end user. The design illustrated in FIGS. 7, 8 is therefore not essentially dependent on the type of runner 3 and this interface system 1 of the invention can easily be mounted on the most varied types of runners 3 or skis 4.

The profiled elements 59 may be made from a plastics material and/or from light metal and the profiled elements 59 will have as low a bending resistance moment as possible. To this end, slits and/or recesses may be provided on the top and/or bottom face as well as on the side regions of the profiled elements 59.

Alternatively, the raised areas 54 may be provided on the top face 8 of the runner 3 in the form of at least two anchoring elements, in particular screws 61, spaced at a distance apart from one another. The head of these anchoring elements or screws 61 in this case will constitute the raised area 54 on the top face 8 of the runner 3. To increase the guide area for the support body 19, these screws 61 may also be provided with sleeves or other elements or fittings that will make for a larger joining area. At least one anchoring element, in particular an appropriately designed screw 61 is provided for each mounting zone 10, 11 to provide an anchoring arrangement in the runner 3.

The advantage of this design is that the interface system 1 proposed by the invention can be mounted or retro-fitted on skis 4 of any type.

The support body 19 of this embodiment, optimised in terms of material and hence also weight, is also retained by the runner 3 by means of clamp-type fixing means 20 so as to slide in the longitudinal direction—indicated by double arrow 17—and is immobile in all spatial directions relative to the runner 3 at only one absolutely fixed position 45. This fixed position 45 is obtained by means of a single fixing screw 41 placed in the end region of the connecting element 34 facing the front mounting zone 10. Alternatively,—as indicated by broken lines—this fixing screw 41 defining the fixed position 45 may also be provided in the foremost end region 12 or in the rearmost end region 13 of the support body 19.

With this embodiment, it is not absolutely necessary to cover the support body 19 and/or the clamp-type fixing means 20 with a separate element. Optionally, the jaw bodies or their guide tracks are designed so that the foxing clamps 35 and/or the mounting zones 10, 11 are already sufficiently well covered by the aforementioned parts.

FIGS. 9 to 14 illustrate another embodiment of the interface system 1 proposed by the invention between a runner 3, in particular a ski 4, and a binding unit, not illustrated, to be mounted thereon. Again with this embodiment, the same reference numbers are used to denote the parts already described above and the preceding descriptions may be transposed in terms of meaning to same parts bearing the same reference numbers.

This embodiment also has a profiled support body 19 which is relatively slim compared with the width of the runner 3 or the ski width in the binding mounting region, only its end regions 12, 13 having sections which are wide enough to be able to support the respective jaw bodies and their guide tracks whilst retaining the requisite dimensional stability when subjected to force. The mounting zones 10, 11 in the end regions 12, 13 of the support body 19 are therefore dimensioned so that the maximum forces which might occur can be absorbed without any significant deviation from the desired position and so that the support body 19 will not break when used for its intended purpose.

With this embodiment, at least one clamp-type fixing means 20 for the support body 91 is provided between the outer anchoring zones 29 for the respective binding part. In particular, the clamp-type fixing means 20 is positioned more or less centrally relative to the front mounting zone 10. The clamp-type fixing means 20 illustrated for this embodiment, in particular the fixing clamps 35 for the support body 19, are secured to the runner 3 with two, in particular with four fixing screws 41. The support body 19 is therefore overlapped in a bridge arrangement by the fixing clamps 35 in the mounting zones 10, 11 and two respective orifices 40 are provided on either side of the support body 19 for the respective fixing clamp 35 or appropriate slits are provided for the fixing screws 41. In this embodiment, the peripheral slits 22 in the mounting regions for the jaw bodies are dimensioned so that the orifices 40 in the fixing clamp 35 lie more or less in alignment with the bores 30 in this support body 19. The transverse extension of the fixing clamps 35 in this embodiment is shorter than the longitudinal extension thereof in the longitudinal direction—indicated by double arrow 17.

The fixing clamps 35 integral with and bridging the length of the support body 19 securely retain the support body 19 on the runner 3. If the mounting plates are of a structurally relatively rigid design, it would also be possible to have an arrangement in which only the longitudinal edge regions of the mounting zones 10, 11 engage with retaining plates of this type, which might be Z-shaped for example.

Similarly, at least in the sections with mounting zones 10, 11, a longitudinal guide device 48 is provided between the support body 19 and the runner 3. To this end, a guide land 62 is provided or formed on at least certain sections of the bottom face 47 of the support body 19. This guide land 62, standing proud of the bottom face 47 of the support body 19, engages at least partially in a groove-shaped recess 56 extending in a longitudinal direction—indicated by double arrow 17—of the runner 3. The contact points between the strip-shaped guide land 62 and the grove-shaped recess 56 in the runner 3 may be made in a linear shape or alternatively as a full surface in places. The only thing which is of importance is that the support body 19 should be retained as far as possible without any clearance, at least in the mounting zones 10, 11, transversely to the longitudinal direction—indicated by double arrow 17—but that it should be guidable in the longitudinal direction—double arrow 17—by the longitudinal guide device 48 in relative displacements in the longitudinal direction—double arrow 17.

Another characteristic feature of this embodiment is the fact that both end regions 12, 13 of the support body 19 and the matching binding support plate 9 are mounted so as to slide freely in their longitudinal guide devices 48 relative to the top face 8 of the runner 3.

The support body 19 or the entire interface system 1 is longitudinally positioned by means of a longitudinal position device 63. In the embodiment illustrated here, this longitudinal positioning device 63 for the support body 19 is disposed in the middle region 32 of the interface system 1. This longitudinal positioning device 63 holds the support body in a retained position in the longitudinal direction—indicated by double arrow 17—of the runner 3 once it has been slidably mounted in the two respective end regions 12, 13. In the embodiment illustrated, this longitudinal positioning device 63 is positioned directly at an assembly mid-point 64 for a ski binding, predetermined by the manufacturer of the runner 3. This assembly mid-point 64 is usually recognisable by appropriate markings on the runner 3.

In the simplest of cases, this longitudinal positioning device 63 might be provided in the form of an appropriate screw with a large enough screw head and shank diameter. If a plurality of orifices for this screw are provided in the support body 19 spaced at a distance apart in the longitudinal direction—indicated by double arrow 17—or an appropriate elongated hole, the support body 19 or interface system 1 can be individually shifted in the longitudinal direction—double arrow 17—of the runner 3 to provide different standing positions for a user in relation to the runner 3.

By preference, the longitudinal positioning device 63 also has a vertical guide device 65, by means of which the support body 19 can be positioned in the specifically provided desired position in the longitudinal direction—indicated by double arrow 17—but remains freely displaceable in a vertical direction perpendicular to the mounting plane 23 and perpendicular to a running surface of the runner 3 opposing the top face 8 of the runner 3. Because of the mounting in the end regions 12, 13, the middle region 32 of the support body 19 will nevertheless follow the deforming motion of the runner 3 in the binding mounting region.

In its simplest format, this vertical positioning device 65 can be provided by the underside of a head of a longitudinal positioning device 63 in the form of a fixing screw 41, lying at a sufficient distance from a top face of he support body 19. With this design, the middle region 32 of the support body 19 is not necessarily also deformed when the runner 3 bends. The middle region 32 of the support body 19 is therefore almost loosely arranged as regards the vertical directions relative to the runner 3 by means of a longitudinal positioning device 63 and vertical guide device 65 of this type. Because the middle region 32 of the support body 19 is not necessarily also deformed by the vertical guide device 65 to produce vertical movements when a ski 4 is subjected to flexing, the inherent bending characteristics of the runner 3 are largely retained.

A maximum displacement path 66 which needs to be provided for the vertical guide device 65 will depend on the maximum bending or flexing of the runner 3 in the binding mounting region and is several mm. The maximum displacement path 66 when the ski is subjected to a relatively high degree of flexing will be approximately 5 mm. In any event, the guide length of the vertical guide device 65 should be dimensioned to suit the maximum displacement path 66 that will occur. Likewise, the displacement path 66 which occurs as a result of the structural design can be purposely restricted by using end stops. An end stop of this type can also be used to prevent lifting, which will prevent the longitudinal positioning device 63 from becoming inactive if unexpectedly long displacement paths 66 occur, in which case the support body 19 would suddenly be released from the longitudinal positioning device 63.

In the embodiment illustrated as an example here, the longitudinal positioning device 63 and vertical guide device 65 are provided in the form of at least one retaining pin 67, which engages in a positive fit at least partially in a matching recess 68. In the embodiment illustrated, the retaining pin 67 is fixedly connected to the runner 3, in particular screwed thereto. The retaining pin 67, disposed perpendicular to the mounting plane 23, therefore engages in at least one, preferably several recesses 68 or retaining supports provided on the bottom face 47 of the support body 19. If this retaining pin 67 and recesses 68 are square-shaped, a vertical guide device 65 can be provided simultaneously, which will permit relative displacements between the support body 19 and the runner 3 in opposing vertical directions.

In the embodiment illustrated as an example here, the longitudinal positioning device 63 to be mounted on the runner side is a separate component, the underside of which is designed so that it can be displaced in engagement with the profiling of the top face 8 of the runner 3. The advantage of this is that the longitudinal positioning device 63 can be accurately and effortlessly mounted on the runner 3 without the need for any awkward mounting or bore templates.

The vertical guide device 65 may be designed so that there is some compensating leeway for the runner 3 during flexing and counter-flexing of the middle region relative to the end regions and the runner 3 will be able to move in a vertical direction as freely as possible relative to the support body 19, both downwards and upwards.

Instead of providing a longitudinal positioning device 63 with a vertical compensating option between the runner 3 and the support body 19, it would naturally also be possible to connect the support body 19 fixedly to the top face 8 of the runner 3 in the region of the longitudinal positioning device 63, in particular to screw it, lock it or similar.

Figure 11:
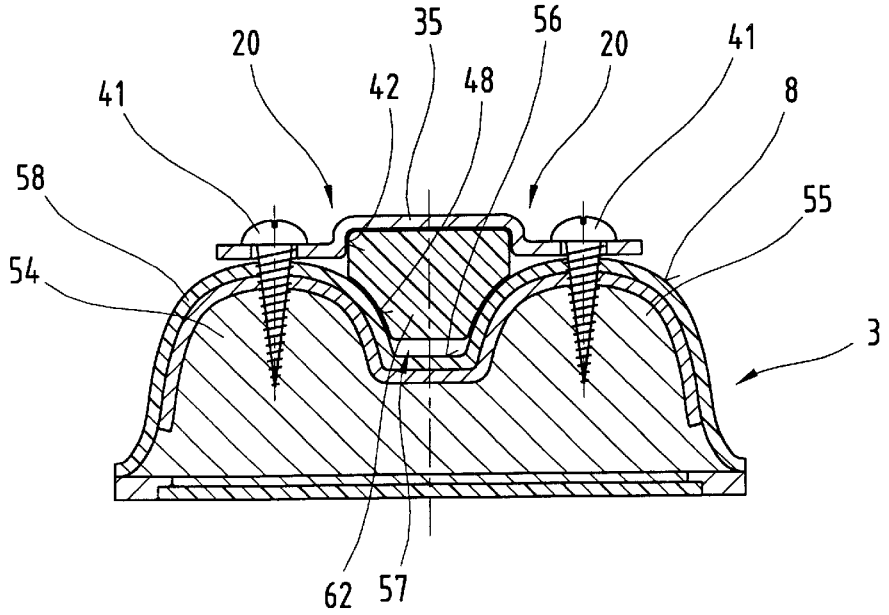
FIG. 11 shows the support body in combination with a profiled runner, in particular a ski, seen in section along the lines XI—XI of FIG. 9.
Figure 12:
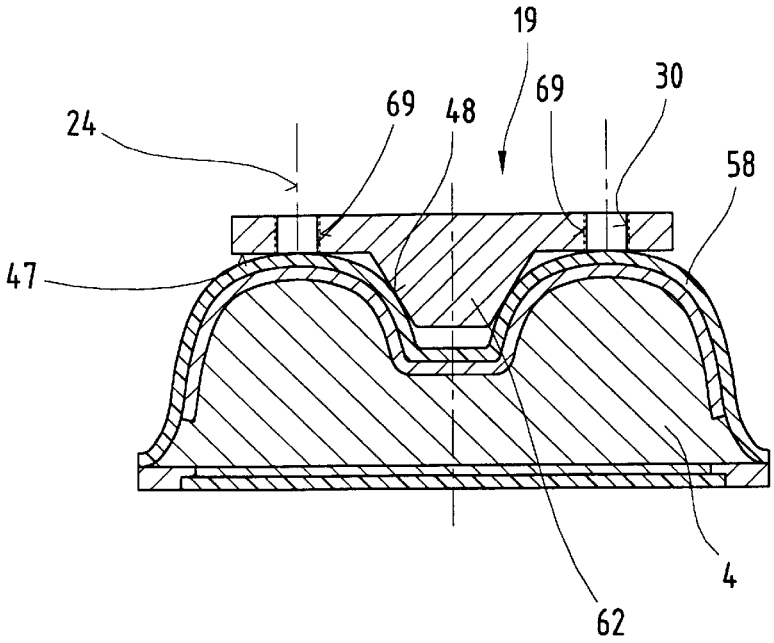
FIG. 12 shows the support body and the runner in the region of a mounting zone for a binding component, seen in section along the lines XII—XII of FIG. 9.
Figure 13:
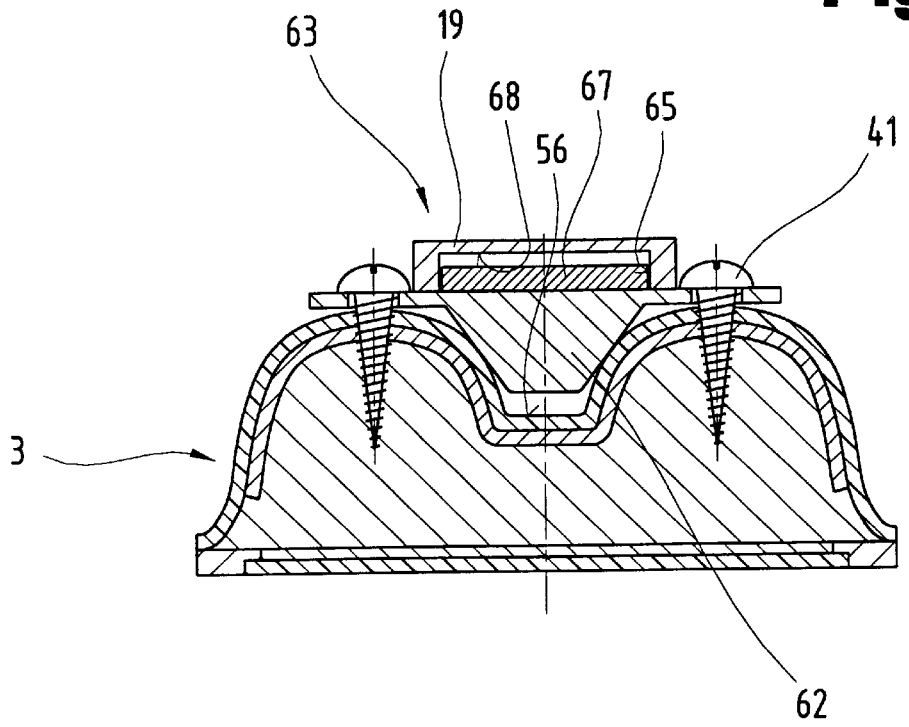
FIG. 13 is a cross section of the support body and the runner in the region of the longitudinal positioning system, seen in section along the lines XIII—XIII of FIG. 9.
Figure 14:
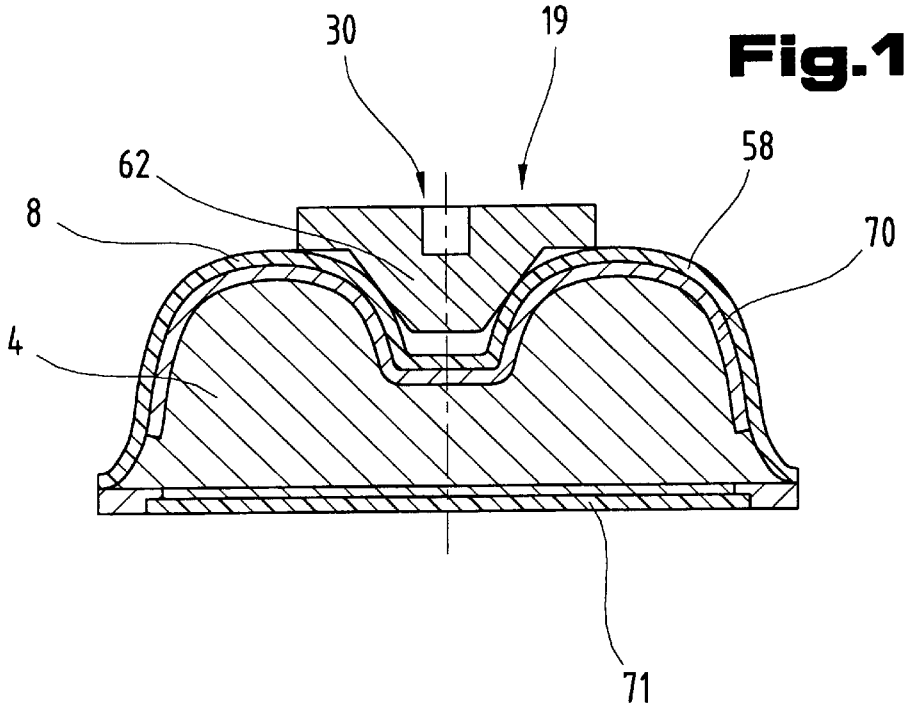
FIG. 14 shows the support body in the region of a braking device to be mounted, seen in section along the lines XIV—XIV of FIG. 9.

The guide passage 57 formed by the clamp-type fixing means 02 co-operating with the negatively or positively shaped surface profiling of the runner 3 can be seen most clearly in FIG. 11. FIGS. 12 and 14 primarily illustrate how the bottom face 47 of the support body 19 engages in the surface profiling of the runner 3 in a positive fit to produce intermittent or linear contact points, which nevertheless afford an adequate transverse stability and guiding accuracy. The advantage of an almost intermittent or linear contact between the bottom face 47 of the support body 19 and the top face 8 of the runner 3 is that the friction surfaces between the support body 19 and the runner 3 are relatively small. In the region of the mounting block, however, the bottom face 47 of the support body 19 sits with the greatest possible part of its surface on the top face 8 of the runner 3 because it is these areas which are subjected to the greatest pressure loads.

The cover element 49, indicated by broken lines, which can be mounted above the support body 19 is preferably only clamped or secured between a corresponding binding unit or between its guide tracks and the support body 19. Accordingly, there is no need for additional screw connections between the cover element 49 and the support body 19. In order to provide an attractive cover for the support body 19 whilst leaving as few gaps as possible, simple snap-fit connections or positive-fit slide connections may be provided between the cover element 49 and the support body 19.

As may best be seen from FIG. 12, the bores 30 for anchoring the corresponding binding body may also be provided by means of bores in the support body 19. The important factor is that the respective fixing screws 24 used to secure the jaw bodies do not penetrate the top face 8 of the runner 3 and are not anchored in the runner 3. It is an advantage, particularly with relatively thin support bodies 19, if the bores 30 are provided with threads 69 which will increase the resistance of the fixing screws 24 to being torn out. Optionally, the bores 30 may also be designed as so-called inserts, which can be anchored particularly securely in the material of the support body 19 to prevent them from being torn out.

As may be seen more particularly in FIG. 14, a braking device for the runner 3 may also be screwed to the support body 19. The mounting position is preferably predefined by means of at least one bore 30 in the support body 19.

Preferably, there are as few friction forces as possible between the bottom face 47 of the support body 19 and the top face 8 of the runner 3. This is achieved due to the fact that the top layer 58 and preferably also the support body 19 are made from a hard plastics material.

The profiling on the top face 8 of the runner 3 is preferably provided as a three-dimensional deformation of the top layer 58 and/or a top surface 70 of the runner 3. This type of profiling can therefore be incorporated in the process of manufacturing the runner 3. The runner 3 is preferably in the form of a sandwich unit, made up of several layers bonded to one another under pressure, primarily comprising a running surface layer 71, a top surface 70 and/or bottom surface, optionally a core component and the top layer 58.

The support body 19 may also be made up of several parts. In particular, the support body 19 may consist of two parts and the facing support body parts will overlap with one another. By adjusting the overlap width, single-piece support bodies 91 of differing lengths can be obtained, enabling different boot sizes to be catered for using a single type of support body 19.

One of the important features is the fact that the support body 19 has a relatively low, longitudinal bending stiffness ($N/mm^2$) perpendicular to the standing plane when subjected to bending stress but a relatively high, lateral bending stiffness ($N/mm^2$), such as can advantageously be obtained due to the positive fit with the runner 3. However, it is not possible to avoid some shortening of the distance between the jaw bodies of the binding unit altogether when the runner 3 is subjected to bending and these can also be compensated by means of a so-called thrust spring arrangement in one of the jaw bodies, preferably in the heel jaw, to avoid too high a degree of strain on the ski boot.

By dimensional stability of the middle region 32 of the support body 19 is primarily meant its relatively low bending resistance with regard to vertical bending stress. Due to the tapered middle region 32, for example, the support body 19 itself, that is to say when dismantled from the runner 3, also has a relatively low torsional stiffness. In terms of tensile stress, on the other hand, the support body 19 is as structurally stable as possible.

For the sake of good order, it should finally be pointed out that in order to provide a clearer understanding of the interface system 1 or binding support plate 9, they and their constituent parts have been illustrated out of scale to a certain extent and/or on an enlarged and/or reduced scale.

The tasks underlying the independent inventive solutions can be found in the description.

Above all, subject matter relating to the individual embodiments illustrated in FIGS. 1, 2; 3, 4, 5, 6, 7, 8; 9, 10, 11, 12, 13, 14 can be construed as independent solutions proposed by the invention. The tasks and solutions can be found in the detailed descriptions relating to these drawings.

LIST OF REFERENCE NUMBERS

1. Interface system
2. Binding unit
3. Runner
4. Ski
5. Jaw body
6. Jaw body
7. Braking device
8. Top face
9. Binding support plate
10. Mounting zone
11. Mounting zone
12. End region
13. End region
14. Length
15. Guide track
16. Guide track
17. Double arrow
18. Locking device
19. Support body
20. Fixing means
21. Orifice
22. Indentations
23. Mounting plane
24. Fixing screw
25. Width
26. Web
27. Supporting rib
28. Longitudinal median axis
29. Anchoring zone
30. Bore
31. Slide plate arrangement
32. Middle region
33. Width
34. Connecting element
35. Fixing clamp
36. Longitudinal edge region
37. Longitudinal edge region
38. Width
39. Length
40. Orifice
41. Fixing Screw
42. Longitudinal guide device
43. Indentations
44. Connecting web
45. Fixed position
46. Bore
47. Bottom face
48. Longitudinal guide device
49. Cover element
50. Material recess
51. Cut-outs
52. Surface
53. Retaining extensions
54. Raised area
55. Raised area
56. Recess
57. Guide passage
58. Cover layer
59. Profiled element
60. Recess
61. Screw
62. Guide land
63. Longitudinal positioning device
64. Assembly mid-point
65. Vertical guide device
66. Displacement path
67. Retaining pin
68. Recess
69. Thread
70. Top surface
71. Running surface layer

What is claimed is:

1. A binding unit support for placing between a binding unit and a board-type runner comprising (a) a support body of a length approximately that of the binding unit and having a longitudinal axis, (1) distal end regions of the support body providing means for receiving jaw bodies of the binding unit, (2) a bottom face of the support body having at least part regions designed to sit on a top face of the board type runner, and (3) a middle region of the support body being of a lesser structural stiffness than the end regions, and (b) a fixing means for mounting the support body on the top face of the board-type runner, the fixing means comprising longitudinally spaced brackets affixed to the board type runner and extending transversely over at least one of the end regions across the support body and guiding the support body for freely sliding in the longitudinal direction relative to the top face of the broad-type runner.

2. The binding unit support of claim 1, wherein the fixing means brackets have a shape adapted to the contour of the support body end region over which it extends.

3. The binding unit support of claim 1, wherein the end regions of the support body form blocks rising above the middle region thereof.

4. The binding unit support of claim 1, wherein the support body, seen in plan view, has the contour of a dog's bone.

5. The binding unit support of claim 1, wherein the support body has a slim, skeletal-type structure.

6. The binding unit support of claim 1, wherein at least the parts regions of the bottom face of the support body have a contour complementing the top face of the board-type runner.

7. The binding unit support of claim 6, wherein at least the part regions of the bottom face of the support body form a positive fit with the top face of the board-type runner.

8. The binding unit support of claim 6, wherein the contour of a least the part regions of the bottom face of the support body and the complementary top face of the board-type runner form a longitudinal guide device extending in the direction of the longitudinal axis.

9. The binding unit support of claim 1, comprising a cover element at least partially covering the support body.

10. The binding unit support of claim 9, wherein the cover element is a flexible injected-molded plastic component.

11. The binding unit support of claim 9, wherein the cover element has a substantially constant width in a longitudinal direction thereof.

12. The binding unit support of claim 9, wherein the cover element determines the visual appearance and external contour of the binding unit support.

13. The binding unit support of claim 1, wherein the distal end regions of the support body have bores for receiving fixing screws for mounting the jaw bodies.

14. The binding unit support of claim 13, wherein the bores have a depth that is shorter than the thickness of the end regions.

15. The binding unit support of claim 1, wherein the fixing means are disposed immediately adjacent the mounting of the jaw bodies.

16. The binding unit support of claim 1, wherein the fixing means are disposed in alignment with the mounting of the jaw bodies.

17. The binding unit support of claim 1, wherein the fixing means brackets are clamps having approximately perpendicularly extending guide arms, a clearing width between the guide arms being smaller than the width of mounting zones extending transversely to the longitudinal axis.

18. The binding unit support of claim 17, wherein at least one of the clamps has at least one retaining extension overlapping a peripheral region of the end region.

19. The binding unit support of claim 18, wherein two outer ones of the retaining extensions have a distance therebetween measured transversely to the longitudinal axis that is longer than the clearing width between the guide arms.

20. The binding unit support of claim 19, wherein the distance between the outer retaining extensions corresponds substantially to the width of the end regions.

21. The binding unit support of claim 1, wherein the middle region of the support body is disposed at least partially in a recess of the top face of the board-type runner.

22. The binding unit support of claim 1, wherein the middle region of the support body is arranged at least partially in a region between a running surface of the board-type runner and a maximum thickness of the runner.

23. The binding unit support of claim 1, wherein the middle region of the support body is of high tensile strength and is a connecting element between the distal end regions which has a significantly lower bending stiffness than the end regions.

24. The binding unit support of claim 23, wherein the middle region of the support body has a low natural stiffness with regard to loads applied perpendicularly to the end regions.

25. The binding unit support of claim 1, comprising means for being fixed exclusively at one point relative to the board-type runner.

26. The binding unit support of claim 25, wherein the one point is disposed in the end region of the support body receiving a front jaw of the binding unit.

27. The binding unit support of claim 25, comprising a longitudinal positioning device in the middle region of the support body for retaining the support body longitudinally aligned with the board-type runner.

28. The binding unit support of claim 27, wherein the longitudinal positioning device accurately retains the support body longitudinally aligned and permits a degree of vertical freedom of the middle region of the support body relative to the top face of the board-type runner.

29. The binding unit support of claim 27, wherein the longitudinal positioning device has a retaining member facing the board-type runner, the retaining member being displaceable in a positive fit engagement with the middle region of the support body.

30. The binding unit support of claim 29, wherein the retaining member has at least one retaining pin extending perpendicularly to the support body.

31. The binding unit support of claim 30, wherein the at least one retaining pin is displaceable in engagement with a respective one of several recesses spaced from each other in the direction of the longitudinal axis of the support body.

32. The binding unit support of claim 29, wherein the retaining member is fixedly mounted on the board-type runner and displaceably holds and locks the support body in the longitudinal direction.

33. The binding unit support of claim 29, wherein the retaining member is mounted centrally relative to the longitudinal extension of the binding unit.

34. The binding unit support of claim 27, wherein the longitudinal positioning device is a substantially clearance-free fixing screw inserted through the middle region of the support body.

35. The binding unit support of claim 34, wherein the fixing screw has a flange whose bottom face is arranged at a distance above a peripheral region around an orifice receiving the fixing screw.

36. The binding unit support of claim 1, wherein the support body has a supporting rib in a region of a sliding plate arranging for mounting a boot.

37. The binding unit support of claim 1, wherein the support body is split in the middle region and an overlap width of the end regions facing each other is variable.

38. A board-type runner having several layers between a running surface layer and a top layer, the layers forming an integral sandwich, and the binding unit support according to claim 1 mounted between a top face of the top layer and a bottom face of the binding unit, at least a part of the top face being three-dimensionally profiled so that the three-dimensionally profiled part of the runner produces an at least partially positive fit with the bottom face of the support body.

39. The board-type runner of claim 38, wherein the three-dimensionally profiled top face part comprises at least one longitudinally extending recess.

40. The board-type runner of claim 38, wherein the three-dimensionally profiled top face part comprises at least one longitudinally extending raised area.

41. The board-type runner of claim 40, wherein the raised area is comprised of a profiled element fixed to the top face.

42. The board-type runner of claim 41, wherein the profiled element is screwed to the top face.

43. The board-type runner of claim 40, wherein the raised area is comprised of at least one screw having an enlarged screw head and anchored in the runner.

* * * * *